US010245566B2

(12) United States Patent
Linne

(10) Patent No.: US 10,245,566 B2
(45) Date of Patent: Apr. 2, 2019

(54) STATIC MIXER

(71) Applicant: Sulzer Mixpac AG, Haag (CH)

(72) Inventor: Volker Linne, Rosenthal (DE)

(73) Assignee: SULZER MIXPAC AG, Haag (CH)

( * ) Notice: Subject to any disclaimer, the term of this patent is extended or adjusted under 35 U.S.C. 154(b) by 452 days.

(21) Appl. No.: 13/737,578

(22) Filed: Jan. 9, 2013

(65) Prior Publication Data

US 2013/0182529 A1 Jul. 18, 2013

(30) Foreign Application Priority Data

Jan. 11, 2012 (EP) ..... 12150755

(51) Int. Cl.
*B01F 5/06* (2006.01)

(52) U.S. Cl.
CPC ..... *B01F 5/0609* (2013.01); *B01F 5/0641* (2013.01)

(58) Field of Classification Search
CPC ..... B01F 5/061; B01F 5/0618; B01F 5/0641; B01F 2005/0625; B01F 2005/0626
USPC ..... 366/336, 337
See application file for complete search history.

(56) References Cited

U.S. PATENT DOCUMENTS 1,491,049 A * 4/1924 Lichtenthaeler ..... B01F 3/0861 261/114.1
1,877,567 A * 9/1932 Erbes ..... F16K 19/00 138/37
4,313,680 A * 2/1982 Honnen ..... B01F 5/0451 366/337
4,514,095 A * 4/1985 Ehrfeld ..... F16L 55/02718 138/42
5,851,067 A 12/1998 Fleischli et al.
5,944,419 A 8/1999 Streiff
7,325,970 B2 2/2008 Keller
7,841,765 B2 11/2010 Keller
8,672,188 B2 3/2014 Rotz et al.
8,753,006 B2 6/2014 Habibi-Naimi
2001/0003291 A1* 6/2001 Uematsu ..... B01F 5/0451 137/888
2002/0097634 A1* 7/2002 Pilkington ..... C12M 27/20 366/337
2003/0179648 A1 9/2003 Heusser et al.
2004/0141413 A1 7/2004 Keller
2006/0187752 A1 8/2006 Keller
2006/0245299 A1 11/2006 Heusser et al.
2007/0144599 A1* 6/2007 Bivin ..... 138/37
2008/0232191 A1 9/2008 Keller
2009/0073800 A1 3/2009 Tarmann et al.
(Continued)

FOREIGN PATENT DOCUMENTS

CH 693560 A5 10/2003
CN 1720094 A 1/2006
CN 101722616 A 6/2010
(Continued)

OTHER PUBLICATIONS

European search report for corresponding EP12150755.2-1253 dated Jun. 22, 2012.

*Primary Examiner* — Marc C Howell
(74) *Attorney, Agent, or Firm* — Global IP Counselors, LLP

(57) ABSTRACT

A mixing element for a static mixer for installation into a tubular mixer housing has a longitudinal axis along which a plurality of installation bodies are arranged behind one another.

20 Claims, 7 Drawing Sheets

(56) References Cited

U.S. PATENT DOCUMENTS

| | | | |
|---|---|---|---|
| 2010/0097883 | A1 | 4/2010 | Habibi-Naini |
| 2013/0235692 | A1 | 9/2013 | Hirschberg |

FOREIGN PATENT DOCUMENTS

| | | | |
|---|---|---|---|
| CN | 101829512 | A | 9/2010 |
| CN | 102294187 | A | 12/2011 |
| EP | 0 749 776 | A1 | 12/1996 |
| EP | 0 815 929 | A1 | 1/1998 |
| EP | 1 312 409 | A1 | 5/2003 |
| EP | 1 426 099 | A1 | 6/2004 |
| EP | 2 181 827 | A2 | 5/2010 |
| WO | 2011162728 | A1 | 12/2011 |

* cited by examiner

STATIC MIXER

PRIORITY CLAIM

The present application claims priority to European Patent Application No. 12150755.2 filed on Jan. 11, 2012, the disclosure of which is incorporated herein by reference.

BACKGROUND

The invention relates to a static mixer of plastic including an installation body for installation into a tubular mixer housing. This installation body has a longitudinal axis which is aligned in the direction of a fluid flowing into the installation body so that a mixing space can be spanned by the installation body. The mixing space has a cross-sectional flow area in a plane normal to the longitudinal axis which essentially corresponds to the cross-sectional flow area of the tubular mixer housing. The installation body includes a wall element for the division and/or deflection of the fluid flow into a direction deviating from the longitudinal axis.

Such a static mixer is, for example, known from EP 1 426 099 B1. In this static mixer, two components are mixed with one another by means of a plurality of mixing elements of the same type in a three-part mixing process in which the material is first divided, then spread and displaced. This mixing process has to be carried out several times depending on the physical properties of the components. For this reason, the static mixer contains a plurality of installation bodies of the same construction arranged behind one another. These mixers are in particular used for the mixing of small quantities of the components, that is a few milliliters to approximately 1,000 milliliters. Accordingly, these mixers have a mixing space with a diameter of less than 16 mm with a length of more than 50 mm. This has the consequence that the wall thicknesses of the wall elements of this mixer can amount to less than 1 mm, often even less than 0.5 mm.

Such a static mixer in accordance with EP 1 426 099 B1 of plastic is preferably manufactured in an injection molding process. The manufacture of a mixer of 30 mm length with a wall thickness of less than 3 mm using the injection molding process, as shown in FIG. 1 of this patent, was previously not possible since the flow path from the injection point of the injection molding tool up to the oppositely disposed end of the mixer would require internal tool pressures which are too high. To be able to manufacture a static mixer having such small wall thicknesses economically in the injection molding process, each installation body is connected to the adjacent installation body via bar elements. These bar elements allow the polymer melt in the injection molding tool to move from one installation body to an adjacent installation body and to maintain the internal tool pressures below 1000 bar so that a failure of the injection molding tool can be prevented such as is shown in an arrangement of two installation bodies in accordance with FIG. 4 of EP 2 181 827 A1 which corresponds in its arrangement of wall elements and deflection elements to the embodiment in accordance with FIG. 15 or FIG. 17 of EP 1 426 099 B1. As a major difference from EP 1 426 099 B2, the bar elements of EP 2 181 827 A1 only serve for the connection of one installation body to an adjacent installation body. In contrast, the bar elements in accordance with FIG. 15 of EP 1 426 099 B1 can extend over a plurality of installation bodies. The bar elements take up mixing space and were therefore avoided where possible or designed in accordance with the previous teaching such that they only connect some of the installation bodies of the mixer with one another; in accordance with FIG. 15 of EP 1 426 099 B1 a maximum of 5 installation bodies. It only became possible by the method in accordance with EP 2 181 827 A1 to provide bar elements which each only connect two adjacent installation bodies to one another. It has, however, proved to be disadvantageous in this development that the stability of the mixing element made up of the installation bodies is also affected. It has in particular been found in the dispensing of viscous materials that the mixing element can break. It was, however, shown on use of an installation body in accordance with EP 2 181 827 A1 that the flow speed of the filler material is subject to great variations.

SUMMARY

It is the object of the invention to provide a mixing element in which the variations of the flow speed of the filler material by an installation body are reduced.

The object of the invention is satisfied by a mixing element whose at least first and second installation bodies are connected to one another via a common bar element, which is connected to an additional separation element. The separation element is formed as a projection which extends from the inner wall of the mixer housing transversely to the longitudinal axis of the mixer into the mixing space. Additionally the mixing element becomes stiffer, that is the resistance to break is increased, by the provision of a bar element.

It was found in an experiment with a filler material A which is marketed under the trade name Voco registrado X-tra and a filler material which B is marketed under the trade name Monopren that the homogeneity of the mixture for a mixing element in accordance with the invention is improved with respect to the prior art with the same mixer length. The mixer can in particular have a larger length due to the smaller pressure loss. The maximum force which can be applied manually to press the filler material through the mixing element is limited. It follows from this that a mixing element which has a reduced pressure loss is simpler to operate with the same construction length. Furthermore, the mixing element in accordance with the invention can be extended with respect to a mixing element from the prior art having installation bodies which have a larger pressure loss. This means that the mixing element can contain more installation bodies than, for example, the mixing element already known from EP 2 181 827 A1 so that the mixing quality can be improved.

The mixing element is provided for a static mixer for installation in a tubular mixer housing. The mixing element has a longitudinal axis along which a plurality of installation bodies are arranged behind one another, with a first installation body having a first wall element which extends in the direction of the longitudinal axis. The wall element has a first side wall and a second side wall which is arranged opposite the first side wall. A deflection element is arranged adjacent to the first wall element and has a deflection surface extending in a transverse direction to the wall element at both sides of the wall element, with a first opening being provided in the deflection surface at a side which faces the first side wall of the wall element.

A second and a third wall element are arranged adjacent to the first opening, with the second and third wall elements extending in the direction of the longitudinal axis and having a respective one inner wall and one outer wall which extend substantially in the direction of the longitudinal axis. Each of the inner walls and outer walls include an angle between 20° and 160° with the first or second side wall of the first wall element. The first opening is arranged between the inner walls of the second and third wall elements and a second opening is arranged outside one of the outer walls of the second or third wall elements, with the second opening being provided in the deflection surface at the side which faces the second side wall of the first wall element.

A second and a third wall element are thus arranged opposite the first wall element adjacent to the first opening in the direction of the longitudinal axis, with the second and third wall elements bounding a passage starting from the first opening and extending in the direction of the longitudinal axis. A second opening is provided in the deflection surface at the side which faces the second side wall of the wall element, with the second or third wall elements adjoining the second opening. Furthermore, the first wall element of the second installation body adjoins the second and third wall elements. At least the first installation body is connected via a common bar element to the second installation body; at least five adjacent installation bodies are advantageously connected to one another via a common bar element. To compensate differences in the flow speed of the filler material, a separation element is provided which is connected to the bar element. The separation element is formed as a projection which extends from the inner wall of the mixer housing transversely to the longitudinal axis of the mixer into the mixing space. The term transversely should here be understood as an angle of at least 45° up to and including 90°.

The separation element is in particular formed as a strip or as rib. A strip or a rib should be understood as an element which has a surface on the luff side which faces the flow, that is the filler material moves toward this luff-side surface in the operating state of the mixer. A lee-side surface is arranged essentially opposite the luff-side surface and is remote from the flow, that is the filler material moves away from the lee-side surface in the operating state of the mixer. The lowest possible spacing of a point on the luff-side surface and on the lee-side surface corresponds to the thickness or wall thickness of the separation element. The wall thickness is usually smaller than the length and/or width of at least one of the luff-side or lee-side surfaces. The luff-side surface and the lee-side surface thus span a wall which has the corresponding thickness or wall thickness. It is naturally possible that the wall thickness is not the same at each point either of the luff-side surface or of the lee-side surface. At least one part of the wall of the separation element is arranged adjacent to the inner wall of the tubular mixer housing. The luff-side surface and/or the lee-side surface can in particular extend transversely to the longitudinal axis of the mixer, that is at least partially have an angle of more than 45° with respect to the longitudinal axis of the mixer. The separation element can in particular be arranged substantially perpendicular to the longitudinal axis of the mixer, that is can in particular include an angle of 90° with the longitudinal axis of the mixer. The separation element is preferably arranged contacting the mixer housing so that the wall flow is deflected via the separation element. This wall flow has a smaller flow speed than the flow in the mixing space formed by the installation body, said flow being free of wall effects. An improved deflection of this wall flow and thus an improved mixing effect can thus be achieved by the separation elements so that the required total length of the mixer can consequently be reduced. Particularly advantageous results were found for separation elements which have a reduction between 20% and 50% of the free cross-sectional area in the mixer available for the fluid flow. If the constriction at the position of the separation element is less than 20%, no measurable improvement of the mixing effect is achieved; if the constriction, that is the reduction in the cross-sectional area, goes beyond 50%, this has the consequence of too high an increase in the pressure loss. This reduction by 20% and 50% of the free cross-sectional area corresponds to a reduction of 5 to 12.5% of the cross-sectional area of the mixer housing, preferably 5 to 10% of the cross-sectional area of the mixer housing.

The separation element preferably has a wall thickness which substantially coincides with the wall thickness of the wall elements or of the deflection elements. The wall thickness can in this respect differ by a maximum of 10%, preferably a maximum of 5%, from the mean wall thickness of the wall elements or of the deflection elements. This range of the wall thickness is particularly advantageous for the processing of the mixer in an injection molding process.

It is furthermore advantageous for the separation elements not to be arranged in a periodically repeating manner in the mixer. This means that at least some of the installation bodies do not contain any separation elements. A local disturbance of the flow hereby takes place, which is advantageous for the mixing effect, but which is ultimately compensated in the region of the mixer between two adjacent separation elements.

The separation element can in particular be formed as a strip or as a rib which extends at least partly at an inner wall of the bar element or as a strip which extends from the bar element to a deflection element. The strip has a luff side onto which a filler material can flow and a lee side which the mixed filler material flows away from. The luff side or lee side can have a surface which is arranged normal to the longitudinal axis of the installation body. It can also have an inclination with respect to the longitudinal axis. The strip can in particular include an angle of 0 to 80° with the longitudinal axis, preferably of 0 to 75°, particularly preferably of 0 to 60°. If the angle of inclination the strip includes with the longitudinal axis increases, the pressure loss also increases, but the degree of deflection of the filler material flow also increases. Depending on the design of the separation element, the degree of deflection can be set via the angle of inclination. The separation element can in particular be formed as an arm which projects into the mixing space bounded by the bar element, by the deflection element and by the wall element. The arm can in particular be formed as a prolongation of one of the wall elements, bar elements or deflection elements.

In accordance with a further embodiment, the separation element can be formed as a strip via which the bar element and the deflection element are connected to one another. This embodiment has as an additional advantage that the installation body can additionally be stiffened by this strip. A bar element can in particular be connected to a further bar element via such a strip.

The second installation body can in particular also have a first wall element which extends in the direction of the longitudinal axis and a first side wall and a second side wall which is arranged opposite the first side wall. A deflection element can be arranged adjacent to the first wall element and the deflection element can have a deflection surface extending in a transverse direction to the wall element at both sides of the wall element, with a first opening being able to be provided in the deflection surface at the side which faces the first side wall of the wall element.

A second and a third wall element can in turn be arranged adjacent to the first opening, with the second and third wall elements extending in the direction of the longitudinal axis and having a respective one inner wall and one outer wall which extend substantially in the direction of the longitudinal axis. Each of the inner walls and outer walls can include an angle between 20° and 160° with the first or second side wall of the first wall element. The first opening can be arranged between the inner walls of the second and third wall elements and a second opening can be arranged outside one of the outer walls of the second or third wall elements, with the second opening being able to be provided in the deflection surface at the side which faces the second side wall of the first wall element.

This means that a second and a third wall element can be arranged opposite the first wall element adjacent to the first opening in the direction of the longitudinal axis, with the second and third wall elements being able to bound a passage starting from the first opening and extending in the direction of the longitudinal axis. A second opening can be provided in the deflection surface at the side which faces the second side wall of the wall element, with the second or third wall elements being able to adjoin the second opening, with the second installation body composed of the first wall element, the deflection element and the second and third wall elements being able to be arranged rotated about the longitudinal axis by an angle of 10° up to and including 180° with respect to the first installation body.

The second installation body can in particular have the same structure as the first installation body. The first installation body can be arranged rotated about the longitudinal axis by an angle of 180° with respect to the second installation body.

All the installation bodies of the mixing element can in particular be connected by means of a bar element. The bar element can be arranged at the outer periphery of the deflection element. A bar element can be provided at each side of the wall element, but a plurality of bar elements can also be provided; in particular two respective bar elements can be provided at each side of the wall element.

The wall element can include an angle of 90 to 130° with the deflection surface.

The deflection surface can have a surface curved at least partly in the direction of the flowing fluid for deflecting the fluid flow in a direction differing from the longitudinal axis; a progressive curvature in the flow direction and in the direction of the mixer housing can in particular be provided.

In accordance with an alternative embodiment, the deflection surface can be substantially planar. The deflection surface can in particular substantially extend at an angle of 90° to the wall element.

The deflection surface of the first installation body is in particular designed so that it covers the openings of the second installation body in the direction of the longitudinal axis.

In accordance with a further embodiment, the surface of the deflection element at the side which faces the first side wall of the wall element can lie at least partly in a transverse plane which is aligned at an angle of 60° to 90° to the longitudinal axis. Furthermore, the surface of the deflection element at the side which faces the second side wall of the wall element can lie at least partly in a transverse plane which is aligned at an angle of 60° to 90° to the longitudinal axis.

A reinforcement element can be provided between the second and third wall elements of the first installation body and the first wall element of the second installation body at their connection point. The transition between the first and second installation bodies can be improved in its shape stability and stiffness by this reinforcement element. The flow cross-section for the polymer melt is also increased at a connection point having a reinforcement element. The reinforcement element can be formed, for example, as a thickened portion or as a rib.

The static mixing element can in particular contain a foamed polymer. With respect to the conventional injection molding process, a polymer containing a foaming agent is used for the manufacture of the static mixer which foams during or directly subsequent to the injection. The injection molding method in particular includes the step of the injection of a polymer containing a foaming agent into an injection molding tool at an inner tool pressure of less than 600 bar, particularly preferably less than 500 bar.

In accordance with an embodiment, a cut-out can be provided in the bar element adjacent to the separation element. A material saving as well as a simplification of the manufacture of the separation element are possible by the cut-out. For example, a movable tool element be used to manufacture the separation element during the manufacture of the installation body in the injection molding process. This movable tool element is introduced into the mixer space through the cut-out and the separation element is manufactured by pulling the tool element out of the mixer space.

A plurality of separation elements can be provided in a parallel arrangement to one another. The separation elements are located next to one another with respect to the longitudinal axis. A strip can, for example be attached to two or more of the total of our bar elements, or an arm can project into the mixer space formed by the installation body.

The separation element which is in particular formed as a strip or as the arm can have a length of at least 1/10 up to half the diameter of the mixer housing enveloping the installation body. The wall thickness of the separation element substantially corresponds to the wall thickness of one of the wall elements or deflection elements.

The surface of the separation element exposed to the flow, that is the luff side thereof, amounts in a projection onto a normal plane to the longitudinal axis to a maximum of half the cross-sectional area of the installation body available for the filler material, preferably to a maximum of one third of the cross-sectional area of the installation body available for the filler material.

A separation element can furthermore be provided in at least a part of the installation body. It is also possible that only one single installation body has a separation element.

Furthermore, separation elements in accordance with one of the following embodiments can be provided in any desired combination.

A static mixer contains a mixing element in accordance with one of the preceding embodiments and a mixer housing which surrounds the mixing element.

The installation body has a length dimension and a diameter. For non-circular tubular mixer housings, the diameter corresponds to the edge length when the cross-sectional area of the tubular mixer housing is square. For other shapes of the mixer housings, for example with rectangular or oval cross-sections, an equivalent diameter $D_a$ is determined under the assumption that the cross-sectional area were circular, that is using the formula $D_a=2*(A/\pi)^{1/2}$. $D_a$ then stands for the equivalent diameter; A for the actual cross-sectional area. The ratio of longitudinal dimension to diameter is at least 1, with either the diameter of the circular cross-section or the equivalent diameter for non-circular cross-sections having to be used as the diameter.

The length dimension is the extent of the installation body in the direction of the longitudinal axis. The ratio of the length dimension to the diameter can in particular be greater than 1.

A plurality of installation bodies can in particular be arranged behind one another along the longitudinal axis. These installation bodies can either have the same construction or installation bodies of different construction can be combined with one another so that a mixer arrangement arises such as is shown in EP 1 312 409 B1. The adjacent installation bodies are connected to one another at least via the bar elements so that the mixing element which is made up of this plurality of installation bodies is designed as a monolithic part. This means that the mixing element is manufactured in its totality in a single injection molding tool.

The installation body or the totality of the installation bodies can have a longitudinal dimension between 5 and 500 mm, preferably between 5 and 300 mm, preferentially between 50 and 100 mm.

The static mixer contains a mixing element in accordance with one of the preceding embodiments and a mixer housing which surrounds the mixing element. The mixing element has a longitudinal axis which coincides with the longitudinal axis of the mixer housing in the assembled state. Each of the installation bodies therefore also has this longitudinal axis. The longitudinal axis is aligned in the direction of a fluid flowing into the static mixer. The fluid includes at least two components which are supplied via an inlet element arranged upstream of the mixing element.

The flow of the fluid to be mixed is deflected in the interior of the mixing space by means of the deflection element so that the components which enter into the tubular mixer housing with an installed mixing element as strands are divided continuously during their path through the static mixer into strips of reducing width, whereby components which are difficult to mix or have high viscosity can also be processed with this static mixer.

The fluid to be mixed as a rule includes two different components. In most cases, the components are present in the fluid state or as viscous materials. These include, for example, pastes, adhesives, but also fluids which are used in the medical sector which contain pharmaceutical agents or fluids for cosmetic applications and foods. Such static mixers are also in particular used as disposable mixers for the mixing of a hardening mixing product of flowable components such as the mixing of multicomponent adhesives. Another preferred use is in the mixture of impression materials in the dental field.

The static mixers described above are suitable as disposable mixers since their manufacturing and material costs are low as soon as the corresponding injection molding tool has been manufactured. Furthermore, the static mixers are used in metering and/or mixing units. The static mixer can be attached to a dispensing unit or to a dispensing cartridge, in particular to a multicomponent cartridge. In particular a multicomponent cartridge can be named as an example which includes a dispensing apparatus and a pipe which is coupled to the dispensing apparatus and which contains a static mixer in accordance with one of the preceding embodiments.

Additional features and advantages are described herein, and will be apparent from the following Detailed Description and the figures.

DETAILED DESCRIPTION

Figure 1:
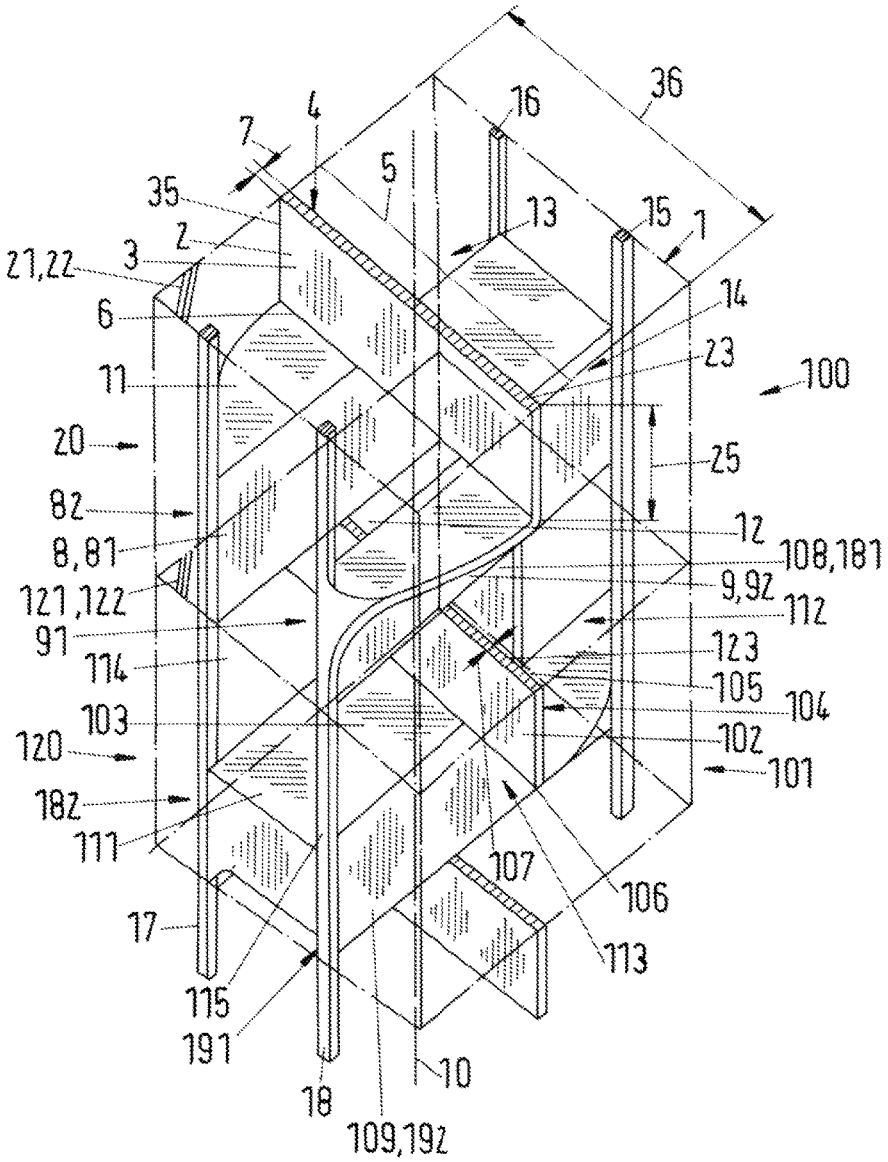
FIG. 1 an embodiment of a detail of a mixing element in accordance with a first embodiment of the invention.

An embodiment of a mixing element 100 for a static mixer in accordance with a first embodiment of the invention is shown in FIG. 1. The mixing element includes an installation body 1 which is installed in a tubular housing which is not shown. The tubular housing serves as a boundary of a mixing space 20 which is located in the interior of the tubular housing. A fluid to be mixed, which is as a rule made up of at least two different components, flows through the mixing space 20. In most cases, the components are present in the fluid state or as viscous materials. These include, for example, pastes, adhesives, but also fluids which are used in the medical sector which include pharmaceutical agents or fluids for cosmetic applications and foods. Such static mixers are also in particular used as disposable mixers for the mixing of a hardening mixing product of flowable components such as the mixing of multicomponent adhesives. Another preferred use is in the mixture of impression materials in the dental field.

The mixing element in accordance with FIG. 1 thus includes an installation body 1 for installation into a tubular mixer housing, with the installation body 1, 101 having a longitudinal axis 10 which is aligned in the direction of a fluid flowing into the installation body 1. A mixing space 20 which is bounded at the peripheral side by a mixer housing, not shown, can be spanned by the installation body 1. A cubic mixing space is indicated in FIG. 1 to facilitate understanding. The side surfaces of the cube can represent the inner walls of the mixer housing. The fluid flows from the top surface of the cube, which forms a cross-sectional flow area 22, in the direction of the installation body 101.

The installation body 1 and the installation body 101 have the same structure; however, the installation body 101 is rotated by 180° about the longitudinal axis 10. Like the mixing space 20, the mixing space 120 has a cross-sectional flow area 122 in a plane 121 arranged normal to the longitudinal axis 10 which essentially corresponds to the cross-sectional flow area of the tubular mixer housing surrounding the installation body 101. For installation bodies 1, 101 which have at least one plane of symmetry which divides the mixing space into two equal parts, the longitudinal axis is disposed in this plane of symmetry. The mixing space is bounded by the mixer housing, not shown. In this embodiment, the mixing element should be installed into a mixer housing have a rectangular or quadratic cross-section. The inner dimension of the mixer housing which is used for determining the equivalent diameter is given by reference line 36.

The installation body 1 contains at least one first wall element 2 which serves a division of the fluid flow into two part flows flowing substantially parallel to the longitudinal axis 109. The wall element 2 has a first side wall 3 and a second side wall 4. The intersection of the first wall element 2 with the plane 21 produces a cross-sectional area 23. This cross-sectional area 23 amounts to a maximum of ⅕, preferably a maximum of 1/10, particularly preferably a maximum of 1/20, of the cross-sectional flow area 22 of the mixing space 20 without installation bodies. The fluid thus flows at both sides of the side walls 3, 4 of the wall element 2. The flow direction of the fluid is indicated by an arrow. The wall element has a substantially rectangular cross-section. The first wall element 2 has a first wide side 5, a second wide side 6 as well as a first and second long side 25, 35. The first wide side 5, the second wide side 6, the first long side 25 and the second long side 35 form the periphery of each of the side walls 3, 4. The long sides 25, 36 extend substantially in the direction of the longitudinal axis 10 and the first wide side 5 and the second wide side 6 extend transversely to the direction of the longitudinal axis. The first wall element 2 divides the mixing space into two parts. The wall element 2 has the function of a bar element which divides the fluid flow into two parts, with their deflection being negligible with the exception of the deflection at the edges of the first wide side 5. The wall thickness 7 of the wall element 2 usually amounts to less than 1 mm for a mixing element with a total length of up to 100 mm.

A deflection element 11 which serves for the deflection of the part flows in a direction differing from the longitudinal axis adjoins the first wall element 2. The deflection element has a deflection surface extending in the transverse direction to the wall element 2 at both sides of the wall element. A first opening 12 is provided in the deflection surface at the side which faces the first side wall 3 of the wall element 2.

The crossing angle between the first wall element 2 and the second or third wall element 8, 9 respectively amounts to 90° in the embodiment in accordance with FIG. 1. In accordance with FIG. 1, the first wall element 2 is connected to the second wall element 8 and to the third wall element 9 via the deflection element 11. The deflection element 11 is preferably disposed in a plane which is aligned parallel to the plane 21 or is arranged at an angle of inclination with respect to the plane, with the angle of inclination amounting to no more than 60°, preferably no more than 45°, particularly preferably no more than 30°. The smaller the angle of inclination between the surface of the deflection element 11 and the plane 21, the smaller the required construction length. Or in other words: the surface of the deflection element 11 is substantially disposed in a transverse plane which is aligned at an angle of 45° up to 90°, preferably of 60° up to 90°, particularly preferably of 75° up to 90°, to the longitudinal axis 10.

The wall elements 8, 9 adjoining the deflection element 11 bound a passage which starts from the first opening 12 and extends in the direction of the longitudinal axis 10. It is meant by the expression "adjoining the deflection element" that the second and third wall elements 8, 9 are arranged opposite the first wall element 2 in the direction of the longitudinal axis, that is are arranged downstream of the first wall element 2 in the direction of flow.

A second opening is provided in the deflection surface at the side which faces the second side wall 4 of the wall element 2, with the second or third wall elements 8, 9 adjoining the second opening. The second and third wall elements 8, 9 bound the same passage which also starts from the first opening 12.

A second and a third wall element 8, 9 are thus arranged adjacent to the first opening 12. The second and third wall elements 8, 9 extend in the direction of the longitudinal axis 10 and each have an inner wall 81, 91 and an outer wall 82, 92 which extend substantially in the direction of the longitudinal axis 10. The second wall element 9 has the inner wall 81 and the outer wall 82. The third wall element 91 has the inner wall 91 and the outer wall 92. In the present embodiment, the inner walls 81, 91 and the outer walls 82, 92 extend in the direction of the longitudinal axis, that is in the vertical direction in the direction of the drawing. Each of the inner walls 81, 91 and outer walls 82, 92 can include an angle between 20° and 160° with the first or second side walls 3, 4 of the first wall element 2. The first opening 12 is arranged between the inner walls 81, 91 of the second and third wall elements 8, 9. A second opening 13 and an optional third opening 14 are arranged outside one of the outer walls 82, 92 of the second or third wall elements 8, 9. The second opening 13 and the third opening 14 are provided in the deflection surface at the side which faces the second side wall 4 of the first wall element 2. The inner wall of each wall element can in particular be parallel to its outer wall. Furthermore, the second and third wall elements can have inner walls 81, 91 and outer walls 82, 92 respectively in parallel with one another.

The first wall element 102 of the second installation body 101 adjoins the second and third wall elements 8, 9. The second installation body 101 has a first wall element 102 which extends in the direction of the longitudinal axis 10 of the mixing element and has a first side wall 103 and a second side wall 104 which is arranged opposite the first side wall 103. The first side wall 103 and the second side wall 104 are arranged substantially parallel to the longitudinal axis 10.

A deflection element 111 is arranged adjacent to the first wall element 102. The deflection element 111 has a deflection surface extending in the transverse direction to the wall element 102 at both sides thereof. A first opening 112 is provided in the deflection surface at the side which faces the second side wall 104 of the wall element 102. A second and a third wall element 108, 109 are opposite the first wall element 102 in the direction of the longitudinal axis 10 adjacent to the first opening 112. That is, the second and third wall elements 108, 109 are located downstream of the first wall element 102. The second and third wall elements 108, 109 bound a passage starting from the first opening 112 and extending in the direction of the longitudinal axis 10. A second opening 113, 114 is provided in the deflection surface at the side which faces the first side wall 103 of the wall element 102. The second or third wall elements 108, 109 adjoin the second opening 113, 114.

A second wall element 108 and a third wall element 109 are arranged adjacent to the first opening 112. The second and third wall elements 108, 109 extend in the direction of the longitudinal axis 10 of the mixing element. The second wall element has an inner wall 181 and an outer wall 182 and the third wall element has an inner wall 191 and an outer wall 192. The outer walls 182, 192 and the inner walls 181, 191 extend substantially in the direction of the longitudinal axis 10 of the mixing element. They are respectively parallel to one another in the present embodiment. Each of the inner walls 181, 191 and outer walls 182, 192 include an angle between 20° and 160° with the first or second side walls 103, 104 of the first wall element 102, 90° in the present case. The first opening 112 is arranged between the inner walls 181, 191 of the second and third wall elements 108, 109 and at least one second opening 113, 114 is arranged outside one of the outer walls 182, 192 of the second or third wall elements 108, 109. The second opening 113 and/or a third opening 114 are provided in the deflection surface at the side which faces the second side wall 104 of the first wall element 102.

The second installation body 101 containing the first wall element 102, the deflection element 111 and the second and third wall elements 108, 109 is arranged rotated about the longitudinal axis 10 by an angle of 10° up to and including 180°, in the specific example of 180°, with respect to the first installation body 1.

The first installation body 1 and the second installation body 101 have the same structure, that is they contain the same wall elements and the same deflection elements which are arranged at respectively the same angles and spacings from one another.

The first installation body 1 and the second installation body 101 are connected to one another via a plurality of common bar elements 15, 16, 17, 18.

Figure 2A:
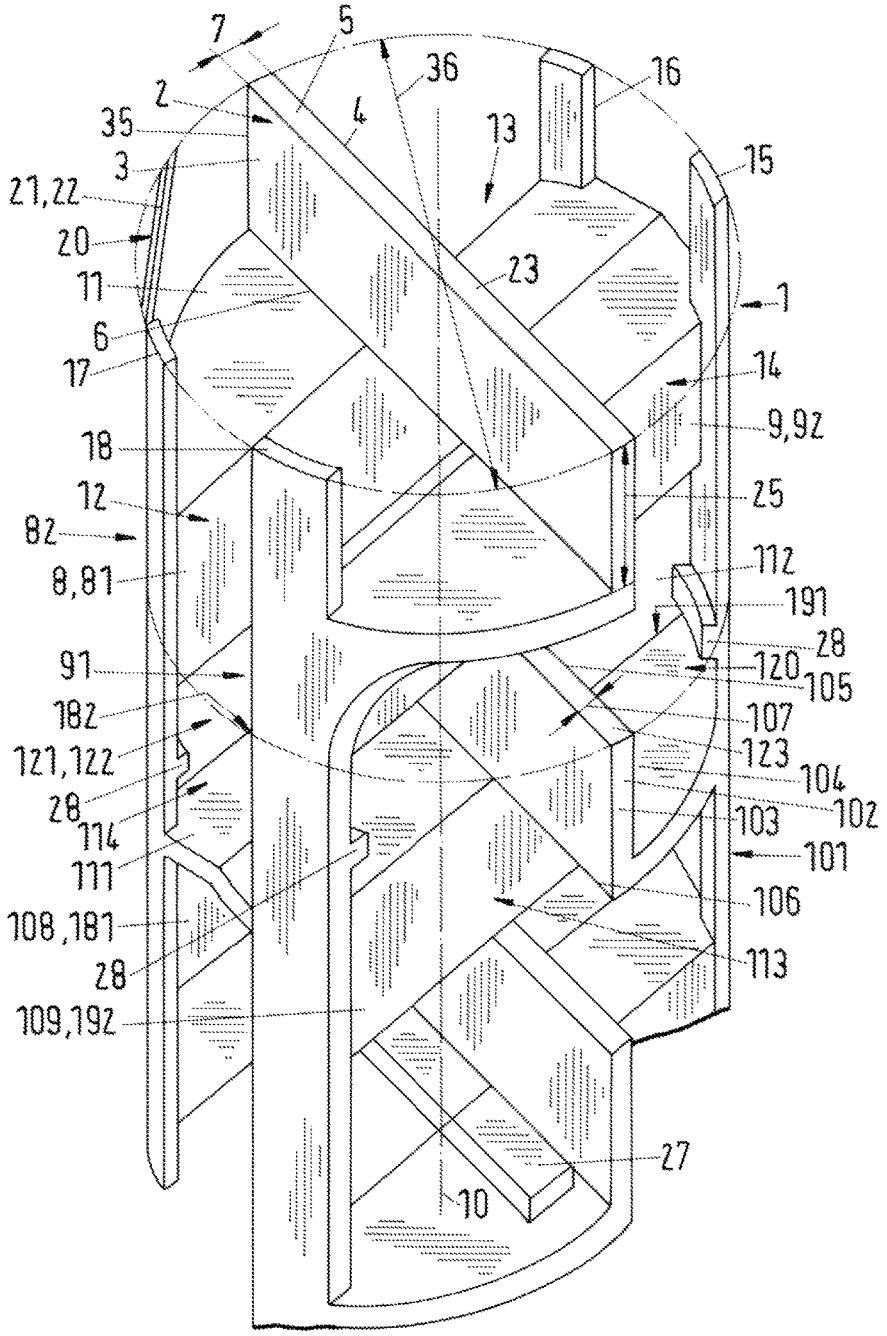
FIG. 2*a* an embodiment of a detail of a mixing element in accordance with a second embodiment of the invention with a separation element in accordance with a first variant.

FIG. 2*a* shows an embodiment of a detail of a mixing element in accordance with a second embodiment of the invention. The structure of the mixing element does not substantially differ from the mixing element in accordance with FIG. 1; the same reference numerals as in FIG. 1 are therefore used for the same parts. Only the differences from the embodiment in accordance with FIG. 1 should be looked at in the following. A first installation body 1 and a second installation body 101 are shown in turn of the mixing element. The installation bodies are intended for installation into a mixer housing which has a circular or elliptical cross-section. The cross-sectional extent of the inner wall of the mixer housing, not shown, is indicated by a chain-dotted line. The diameter of the mixer housing is shown by a reference line 36. FIG. 2*a* furthermore shows a separation element 27 which is formed as an arm as well as two separation elements 28 which are formed as strips extending at the inner wall of the bar element 15, 17, 18. In accordance with a variant, the strips can naturally also be attached to the bar element 16 or also only to one of the bar elements.

Figure 2B:
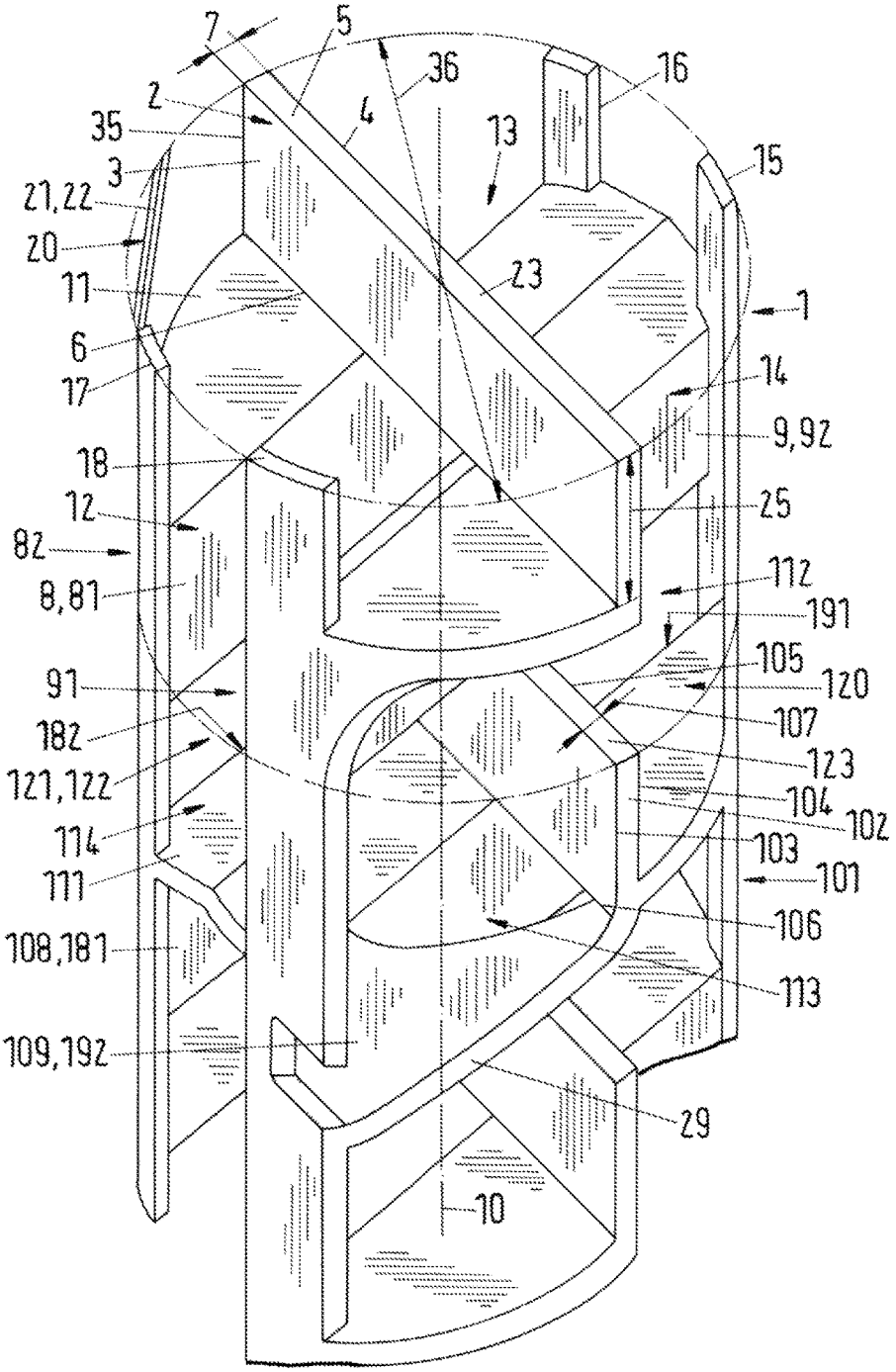
FIG. 2*b* an embodiment of a detail of a mixing element in accordance with a second embodiment of the invention with a separation element in accordance with a second variant.

FIG. 2*b* shows an embodiment of a detail of a mixing element in accordance with the second embodiment of the invention with a separation element 29 in accordance with a second variant. This separation element is formed as a connection surface between the bar element 18 and the wall element 102.

Figure 2C:
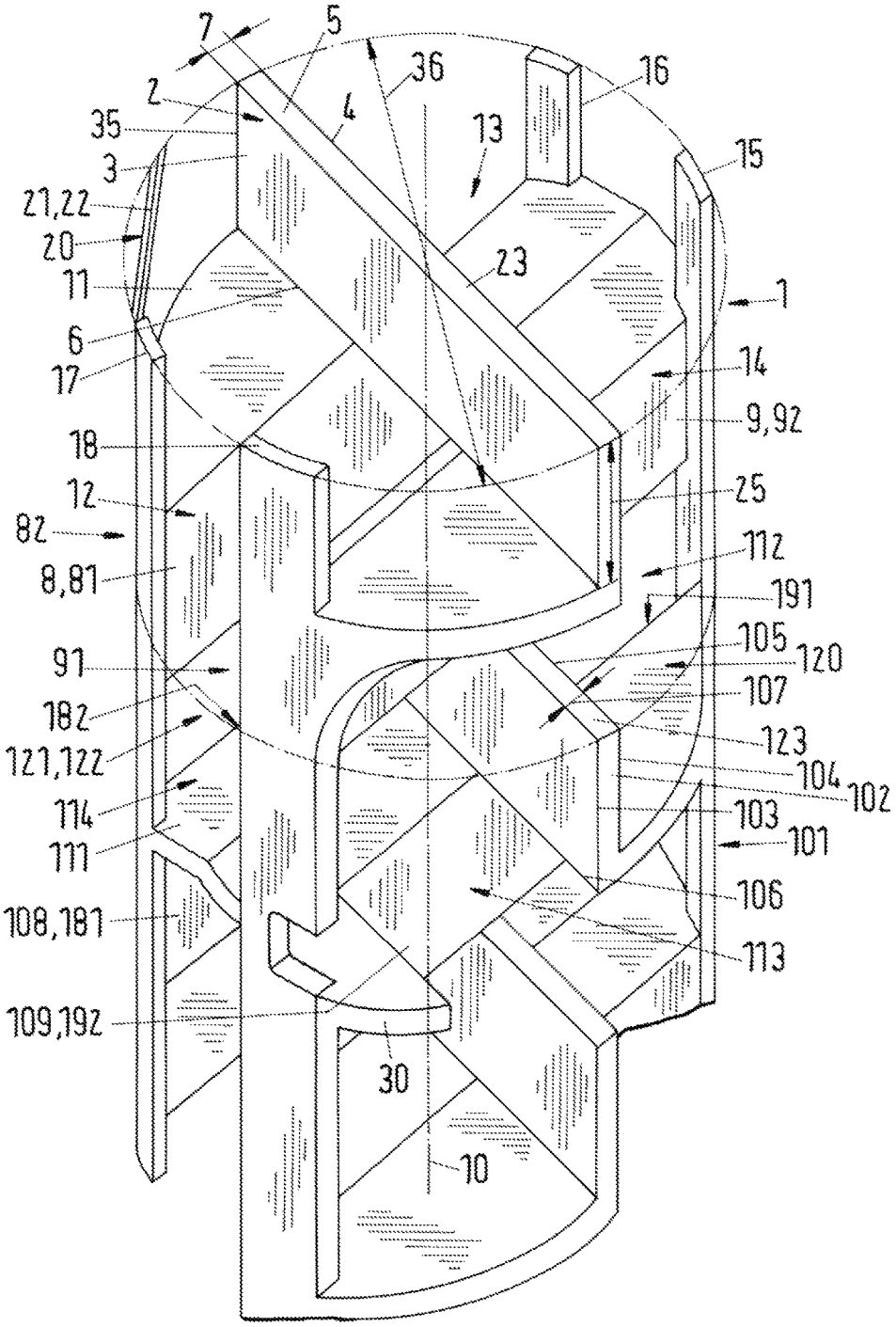
FIG. 2*c* an embodiment of a detail of a mixing element in accordance with a second embodiment of the invention with a separation element in accordance with a third variant.

FIG. 2*c* shows an embodiment of a detail of a mixing element in accordance with a second embodiment of the invention with a separation element 30 in accordance with a third variant. This separation element 30, unlike the strip, forms a deflection surface which is substantially wider than the wall thickness of the separation element. In addition, a cut-out is provided in the bar element to which the separation element 30 is attached.

Figure 2D:
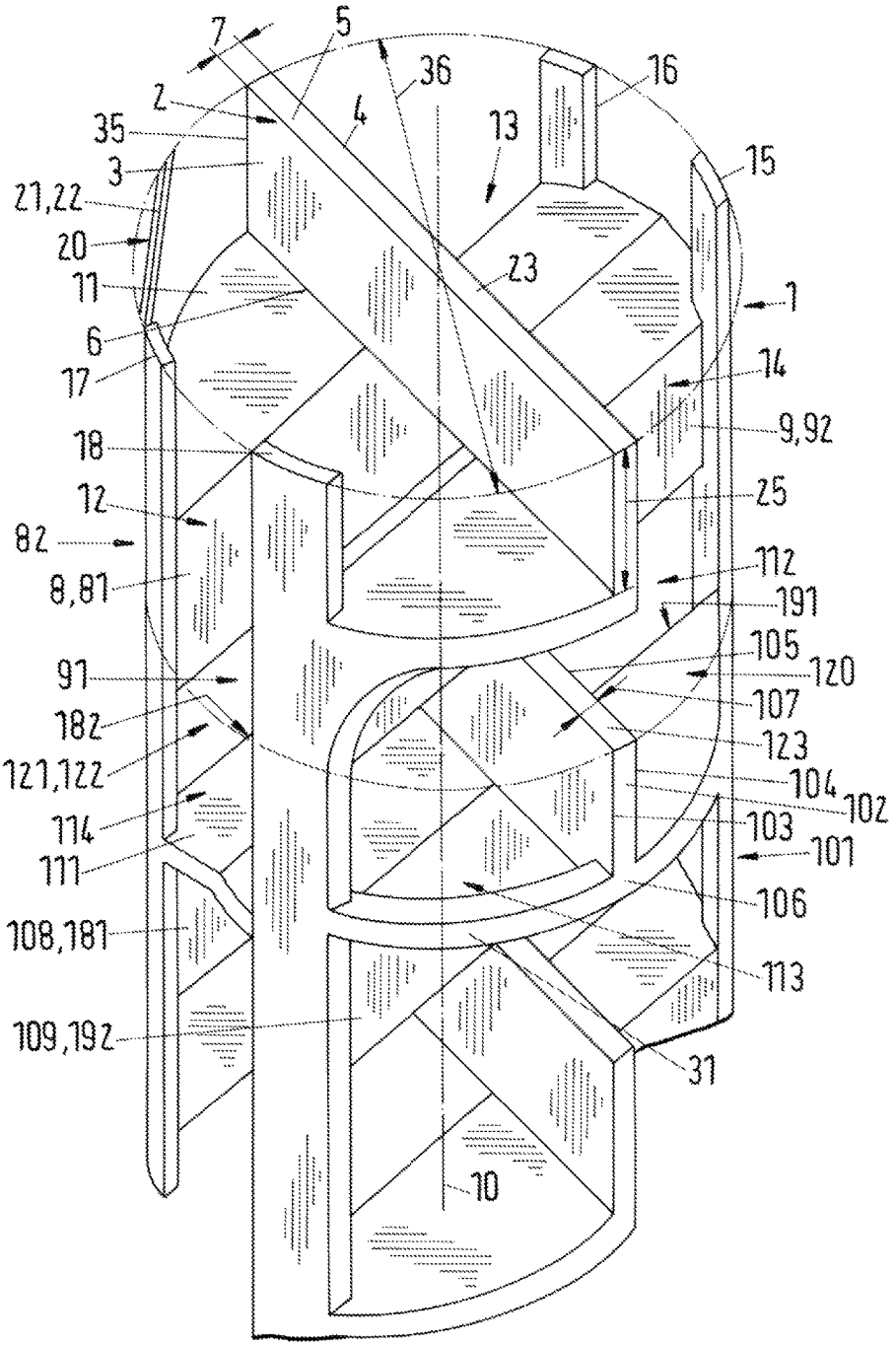
FIG. 2*d* an embodiment of a detail of a mixing element in accordance with a second embodiment of the invention with a separation element in accordance with a fourth variant.

FIG. 2*d* shows an embodiment of a detail of a mixing element in accordance with a second embodiment of the invention with a separation element 31 in accordance with a fourth variant. This separation element 31 forms a strip which connects the bar element to the wall element 102. The separation element 31 differs from the separation element 29 in that no specific connection surface is formed. The width of the surface of the separation element facing the filler material does not substantially differ from the wall thickness of the separation element. In the assembled state, the outer surface of the separation element extends along the inner wall of the mixer housing. This separation element can in particular also contribute to the increase in the stability of the installation body since it acts in a similar manner to a brace.

Figure 3:
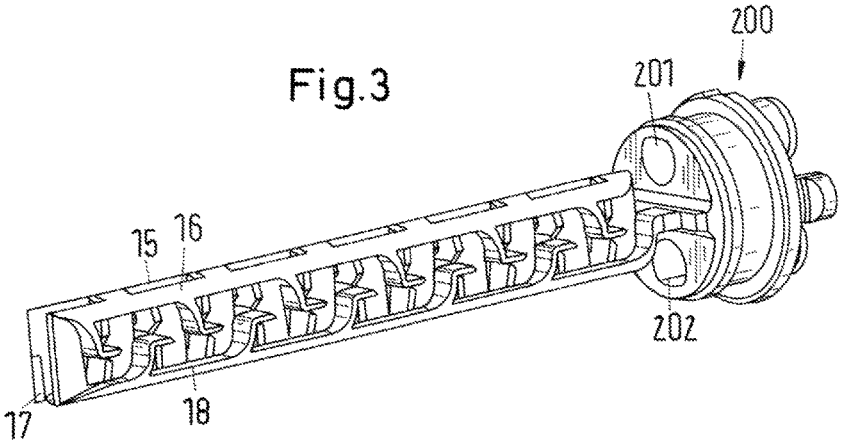
FIG. 3 a view of a mixing element with installation bodies in accordance with FIG. 2, FIG. 4 a section through an installation body in accordance with FIG. 2, FIG. 5 a section through the installation body which is arranged adjacent to the installation body in accordance with FIG. 4; and, FIG. 6 a section through an inlet part of a static mixer and mixing element in accordance with FIG. 3.

FIG. 3 shows a view of a first embodiment of a mixing element in accordance with the invention. The mixing element contains installation bodies, as shown in FIG. 2. Furthermore, the mixing element contains an inlet element which contains the feed passages for the components to be mixed. The mixing ratio of the two components can be equal to 1:1, but can also be different, that is not equal to 1:1. 11 installation bodies are shown in FIG. 3. All installation bodies are connected to one another by bar elements 15, 16, 17, 18.

Figure 4:
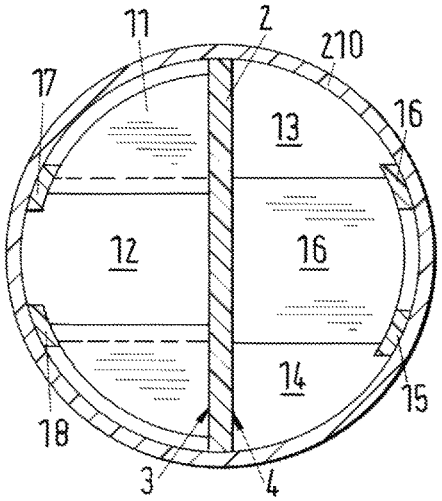

FIG. 4 shows a section through the installation body 1 in accordance with FIG. 2. The first wall element 2 and the bar elements 15, 16, 17, 18 are cut. The deflection element 11 is visible in the section in accordance with FIG. 4. The deflection element 11 contains the first opening 12 which is arranged at the left side of the first wall element 2 in FIG. 4, that is on the side of its first side wall 3. The second opening 13 and the third opening 14 are arranged on the opposite side, that is on the second side wall 4. The first opening 12 is arranged offset with respect to the second and third openings 13, 14. A part element 26 of the deflection element is arranged between the second and third openings. The fluid which impacts onto the part element 26 is deflected in the direction of the second opening 13 and of the third opening 14. At the peripheral side, the second opening 13 and the third opening 14 are bounded by the mixer housing 210.

Figure 5:
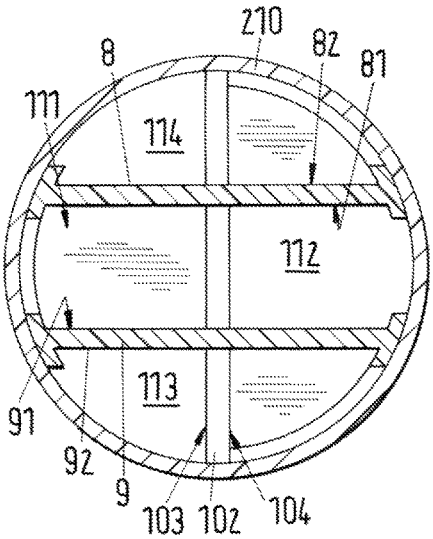

FIG. 5 shows a section through the second and third wall elements 8, 9 of the installation body 1. The direction of gaze is in the flow direction so that the first wall element 102 of the installation body 101 is visible. The deflection element 111 adjoins the first wall element 102 of the installation body 101. The deflection element 111 contains a first opening 112 which is arranged on the side of the second side wall 104. A second opening 113 and a third opening 114 are arranged on the side of the first side wall 103. The second opening 113 and the third opening 114 are arranged offset to the first opening 112. The first, second and third openings 112, 113, 114 are arranged such that a part element is respectively arranged opposite each of the openings, that is a first part element opposite the first opening 112, a second part element 127 opposite the second opening 113 and a third part element 128 opposite the third opening.

Figure 6:
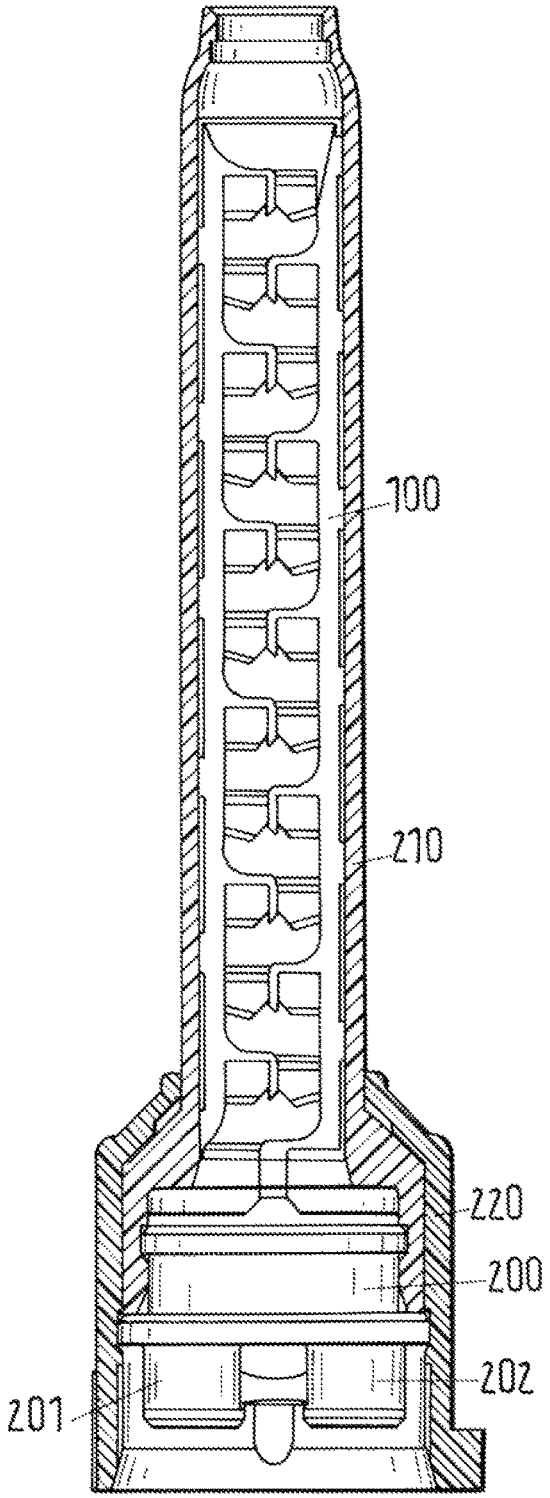

FIG. 6 shows a section through an inlet part of a static mixer and a mixing element in accordance with FIG. 3. The static mixer includes a mixer housing 210 in which the mixing element and the inlet element are received. The mixer housing is received in a connection element 220 which serves for connection to a cartridge.

The bar elements 15, 16, 17, 18 hold all installation bodies of the mixing element connected to one another. Each of the bar elements increases the bending stiffness of the static mixer. It can furthermore be prevented by the bar elements that a break of the mixing element occurs in the operation of the mixer, in particular when at least two mixing elements are arranged on opposite sides of the first wall elements. Furthermore, it is ensured via the bar element during the manufacture of the installation body in the injection molding process that the polymer melt can flow from the first installation body 1 to the first and all further installation bodies 101 arranged downstream. Without the bar elements, the transition from the wall element 8 or 9 to the wall element 102 disposed downstream would namely only be composed of the common sectional surface and any reinforcement thereof. That is the sectional surface in this case is composed of two squares which would have a side length corresponding to the wall thickness 7. The total polymer melt for the installation bodies disposed downstream would have to pass through these restriction points, which would result in local pressure peaks in the tool. In addition, a long dwell time of the polymer melt would result in the regions of the wall elements which would come to lie close to the tubular housing in use, which would result in variations in the polymer melt and under certain circumstances in a deterioration of the physical properties and in inhomogeneity so that such a mixing element can only be manufactured in the prior art by the use of a melt containing a foaming agent for generating a foamed structure.

For this reason, in accordance with the invention, the bar elements for forwarding the polymer melt in the manufacturing process are provided from one installation body to each of the adjacent installation bodies.

The static mixer is usually produced from plastic by means of which even comparatively complicated geometries can be realized in the injection molding process. The totality of installation bodies 1, 101 has a length dimension 24 and each of the cross-sectional areas 23, 123 have a wall thickness 7 in particular for static mixers including a plurality of installation bodies. The ratio of length dimension 24 to wall thickness 7 amounts to at least 40, preferably at least 50, particularly preferably at least 75. For the preferred use of static mixers for small quantities of filler material, the wall thickness 7 is less than 3 mm, preferably less than 2 mm, particularly preferably less than 1.5 mm. The totality of the installation bodies 1, 101 has a length dimension 24 between 5 and 500 mm, preferably between 5 and 300 mm, preferentially between 50 and 100 mm.

The pressure loss and the required mixer length of mixers in accordance with the invention and of the embodiments in accordance with the invention with a separation element will be compared in the following.

A helical mixer (I), a mixer in accordance with EP 1 426 099 (Type MBT 6.5-12-D), a mixer in accordance with EP 2 181 827 (Type MBT 6.5-12-DV3), a mixer in accordance with a first embodiment with a ring-shaped separation element (Type MBT 6.5-12-D Ring, FIG. 2*d*), furthermore a mixer in accordance with the embodiment in accordance with FIG. 2*a*, a mixer in accordance with the embodiment in accordance with FIG. 2*b*, a mixer in accordance with the embodiment in accordance with FIG. 2*c*.

All simulations were carried out using a filler material having the same physical properties.

| Type | CoV | Pressure [bar] | Volume [cm$^3$] |
|---|---|---|---|
| MB6.5-11-D (I) | 0.035 | 2.80 | 2.27 |
| MBT6.5-12-D (II) | 0.030 | 3.56 | 1.73 |
| MBT6.5-12-DV3 (III) | 0.022 | 3.28 | 1.65 |
| MBT6.5-12-D Ring (FIG. 2d) (IV) | 0.013 | 3.15 | 1.63 |
| FIG. 2a (V) | 0.020 | 3.25 | 1.65 |
| FIG. 2b (VI) | 0.017 | 3.30 | 1.63 |
| FIG. 2c (VII) | 0.018 | 3.20 | 1.63 |

Column 2 of the table shows the mixing quality (CoV) for the individual mixer types in accordance with column 1.

The mixing quality in a plane A is described by means of the coefficient of variation CoV. It is defined as the standard deviation of the concentration distribution in A standardized with the mean value of the concentration $\bar{c}$ in A.

$$CoV = \frac{\sqrt{\frac{1}{A}\int_A (c-\bar{c})^2 dS}}{\bar{c}}$$

$$\bar{c} = \frac{1}{A}\int_A c dA$$

With a better mixing, the CoV becomes smaller. For the comparison of different mixers, the reduction in the coefficient of variation CoV was determined over a predefined mixer length with the same distribution and thus also the same CoV before the mixers; the mixer which has a smaller CoV in accordance with the predefined length therefore mixes more intensely or better.

The pressure set down in the table is the pressure which has to be applied to convey the corresponding filler material through the mixer. The volume corresponds to the volume of the filler material which remains in each of the mixers I, II, III, IV, V, VI, VII, that is the loss portion of the filler material. It is a general objective, above all for expensive filler materials, to minimize this loss portion as much as possible.

Not only clear differences between mixers of different geometrical construction, such as the helical mixer I and the mixer II, are revealed, but also clear differences between the mixers of substantially the same construction II-VII. The difference in mixing quality between mixer II and mixer III is due to the surprising effect described in EP 2 181 827 A1 in accordance with which the provision of bars which connect a plurality of mixing elements to one another surprisingly effects a reduction in the pressure even though the volume of the mixer III available for the filler material is less than that of mixer II. When the volume available for the filler material in the mixer decreases, the expectation is that the pressure required for conveying the filler material increases since a smaller volume gives rise to the expectation of a smaller free cross-sectional area and thus a greater constriction effect. The change in the volume available for the filler material is at around 5% in this example. At the same time, this means that the loss portion, which corresponds to the volume in the inner mixer space which is taken up by the filler material, reduces by around 5%.

It furthermore resulted from the simulations that further improvements in the mixing quality of the mixer III are surprisingly possible. Each of the mixers IV, V, VI, VII has a higher mixing quality than mixer III. This effect is due to the separation elements such as are shown in the embodiments in accordance with FIG. 2*a*, FIG. 2*b*, FIG. 2*c* and FIG. 2*d*. Surprisingly, both an improvement in the mixing quality is achieved and the pressure is reduced. The volume can be reduced, that is the loss portion can be reduced, due to the improvement in the mixing quality. This means that the mixer in accordance with one of the variants in accordance with the invention can be operated at a lower pressure than the prior art and that the mixer has an equal or even smaller mixer length.

On a comparison of all mixer types based on the mixing quality of the helical mixer 0.035, the percentage improvements of mixers IV, V, VI, VII shown in the following table result in comparison with mixer III.

| Mixer | Pressure [%] | Vol. [%] |
|---|---|---|
| (I) | 135.81% | 218.87% |
| (II) | 148.00% | 143.18% |
| (III) | 100.00% | 100.00% |
| (IV) | 56.75% | 58.50% |
| (V) | 90.08% | 90.73% |
| (VI) | 77.74% | 76.11% |
| (VII) | 79.82% | 81.00% |

Mixers I and II from the prior art accordingly deliver substantially poorer values for the pressure and for the volume required for the mixing.

On a comparison of all mixer types based on the mixing quality of the helical mixer 2.80, the percentage improvements of mixers IV, V, VI, VII shown in the following table result in comparison with mixer III.

| Mixer | Pressure [%] | Vol. [%] |
|---|---|---|
| (I) | 135.81% | 117.44% |
| (II) | 148.00% | 113.96% |
| (III) | 100.00% | 100.00% |
| (IV) | 56.75% | 95.08% |
| (V) | 90.08% | 98.89% |
| (VI) | 77.74% | 99.10% |
| (VII) | 79.82% | 96.59% |

Mixers I and II from the prior art accordingly deliver substantially poorer values for the pressure and for the volume required for the mixing. Mixer IV must in particular be emphasized in this connection whose pressure is almost 50% lower than that of mixer III which does not differ greatly in construction.

Comparison with mixers I and II accordingly deliver even greater improvements. Both an improvement in the mixing quality and a reduction in the pressure which is required to urge the filler material through the mixer and to dispense it can thus surprisingly be achieved by the provision of separation elements.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A mixing element for a static mixer configured to be installed into a tubular mixer housing, comprising:

a plurality of installation bodies arranged in series along a longitudinal axis of the mixing element including a first installation body having a first wall element extending in a direction of the longitudinal axis, a first side wall and a second side wall arranged opposite the first side wall, a deflection element arranged adjacent to the first wall element, the deflection element having a deflection surface extending in a transverse direction to the first wall element at both sides of the wall element, the deflection surface having a first opening at a side facing the first side wall of the first wall element, a second wall element and a third wall element arranged adjacent to the first opening, the second and third wall elements extending in the direction of the longitudinal axis, each of the second and third wall elements having an inner wall and an outer wall extending substantially in the direction of the longitudinal axis, each of the inner walls and outer walls including an angle between 20° and 160° with one of the first and second side walls of the first wall element, the first opening of the deflection surface being arranged between the inner walls of the second and third wall elements, a second opening arranged outside one of the outer walls of one of the second and third wall elements, the second opening being disposed on the deflection surface at a side facing the second side wall of the first wall element, a first wall element of a second installation body adjoining the second and third wall elements, the first installation body being connected to the second installation body via a common bar element; and at least two separation elements connected to the bar element, the separation elements being located next to one another with respect to the longitudinal axis of the mixing element, and being formed as a projection extending only partially circumferentially around an inner wall of the mixer housing, each separation element of the separation elements defining a plane that is substantially perpendicular to the bar element.

2. The mixing element in accordance with claim 1, wherein each of the separation elements is formed as one of a strip and a rib having an angle, at least partly, of more than 45° with respect to the longitudinal axis of the mixer.

3. The mixing element in accordance with claim 1, wherein each of the separation elements is one of a strip and a rib.

4. The mixing element in accordance with claim 1, wherein a free cross-sectional area of the mixer housing is reduced by 5 to 12.5% by the separation elements.

5. The mixing element in accordance with claim 1, wherein a wall thickness of each of the separation element differs by a maximum of 10% of a mean wall thickness of one of the wall elements and the deflection elements.

6. The mixing element in accordance with claim 5, further comprising the plurality of separation elements are arranged along the longitudinal axis of the mixing element such that a distance between adjacent pairs of separation elements is not equal to a distance between subsequent pairs of adjacent separation elements.

7. The mixing element in accordance with claim 1, wherein each of the separation elements is one of a strip and a rib extending at least partly at an inner wall of the bar element.

8. The mixing element in accordance with claim 7, wherein the deflection element is one of a plurality of deflection elements, the bar element is one of a plurality of bar elements, and each of the separation elements is a strip extending from a respective bar element to a respective deflection element.

9. The mixing element in accordance with claim 1, wherein each of the separation elements has an arm projecting into the mixer space.

10. The mixing element in accordance with claim 8, wherein each of the separation elements is connected to the respective bar element and to the respective deflection element.

11. The mixing element in accordance with claim 8, wherein a first bar element and a second bar element of the plurality of bar elements are connected to one another via one of the separation elements.

12. The mixing element in accordance with claim 1, wherein the second installation body has the first wall element extending in the direction of the longitudinal axis, the second installation body having a first side wall and a second side wall arranged opposite the first side wall, a deflection element being arranged adjacent to the first wall element and the deflection element having a deflection surface extending in the transverse direction to the wall element at both sides of the wall element, the deflection surface of the second installation body having a first opening at a side of the deflection surface facing the second side wall of the wall element, a second wall element and a third wall element being arranged adjacent to the first opening and extending in the direction of the longitudinal axis, each of the second and third wall elements having an inner wall and an outer wall extending substantially in the direction of the longitudinal axis, each of the inner walls and outer walls including an angle between 20° and 160° with the first or second side walls of the first wall element, the first opening of the deflection surface being arranged between the inner walls of the second and third wall elements and a second opening being arranged outside one of the outer walls of the second or third wall elements, the second opening is provided in the deflection surface of the second installation body at side facing the second side wall of the first wall element, the second installation body containing the first wall element, the deflection element and the second and third wall elements being rotatably arranged about the longitudinal axis by an angle between 10° and 180° with respect to the first installation body.

13. The mixing element in accordance with claim 12, wherein the second installation body has the same structure as the first installation body.

14. The mixing element in accordance with claim 12, wherein the bar element is arranged at an outer periphery of the deflection element.

15. The mixing element in accordance with claim 4, wherein the free cross-sectional area of the mixer housing is reduced by 5% to 10% by the separation elements.

16. The mixing element in accordance with claim 5, wherein the wall thickness of the separation elements differs by a maximum of 5% of the mean wall thickness of one of the wall elements and the deflection elements.

17. The mixing element in accordance with claim 13, wherein the first installation body is rotatably arranged rotated about the longitudinal axis by an angle of 180° with respect to the second installation body.

18. The mixing element in accordance with claim 1, wherein each of the separation elements is an arcuate strip having a wall thickness that is less than a length extending in a circumferential direction of the strip.

19. The mixing element in accordance with claim 18, wherein the bar element is one of a plurality of bar elements, and each of the separation elements is a prolongation of a respective bar element.

20. A static mixer comprising the mixing element in accordance with claim 1 and further comprising a mixer housing surrounding the mixing element.

* * * * *